US006602385B1

(12) United States Patent
Drummond

(10) Patent No.: US 6,602,385 B1
(45) Date of Patent: Aug. 5, 2003

(54) METHOD OF IMPROVING THE BRIGHTNESS OF CALCIUM CARBONATE FILLED PAPER

(75) Inventor: Donald Kendall Drummond, Glenmoore, PA (US)

(73) Assignee: Minerals Technologies Inc.

( * ) Notice: Subject to any disclaimer, the term of this patent is extended or adjusted under 35 U.S.C. 154(b) by 0 days.

(21) Appl. No.: 08/790,144

(22) Filed: Jan. 28, 1997

Related U.S. Application Data

(63) Continuation of application No. 08/365,253, filed on Dec. 28, 1994, now abandoned.

(51) Int. Cl.[7] ..... D21C 9/10; D21C 9/16; D21H 21/22

(52) U.S. Cl. ..... 162/78; 162/80; 162/83; 162/181.2; 162/181.4; 162/201

(58) Field of Search ..... 162/78, 80, 83, 162/158, 181.2, 181.4, 201, 100; 8/111

(56) References Cited

U.S. PATENT DOCUMENTS 2,150,926 A 3/1939 Kauffman et al.
2,510,595 A * 6/1950 McEwen et al. ..... 162/13
2,613,579 A 10/1952 McEwen et al.
4,083,749 A * 4/1978 Miwa et al. ..... 162/181.2
5,181,988 A * 1/1993 Akutsu ..... 162/158
5,443,634 A * 8/1995 Francis et al. ..... 106/287.23
5,527,430 A * 6/1996 Gill ..... 162/158

FOREIGN PATENT DOCUMENTS

WO WO 93/22501 * 11/1993 ..... 162/78

OTHER PUBLICATIONS

Calkin, "Modern Pulp and Paper Making" Third Edition, Reinhold, Publishinh Corp., London 1957, pp. 6, 7, 312, 313.*

Tang, American Chemical Society "Stabilization of Paper Through Sodium Borohydride Treatment", (1986), pp. 212, 427–441.

* cited by examiner

*Primary Examiner*—Steve Alvo
(74) *Attorney, Agent, or Firm*—Marvin J. Powell; Michael J. Herman

(57) ABSTRACT

A method of improving the brightness of calcium carbonate filled paper. The filled paper is dried and then bleached with an aqueous solution of a bleaching agent. The process may be used on all grades of paper that contain filler and is particularly useful in the bleaching of low brightness grade papers that are produced from mechanical pulp that contain calcium carbonate.

2 Claims, No Drawings

METHOD OF IMPROVING THE BRIGHTNESS OF CALCIUM CARBONATE FILLED PAPER

This is a continuation of application Ser. No. 08/365,253 filed Dec. 28, 1994, now abandoned.

FIELD OF THE INVENTION

The present invention relates to a method for improving the optical properties of filled paper. More particularly, the present invention relates to a method for improving the brightness of paper containing calcium carbonate by treating the filled paper with bleaching agents.

Papers produced according the process of the above invention allow papermakers to charge a premium price for the product, while obtaining improved optical properties without significantly increasing the cost of production.

The invention may be used on all grades of paper that contain filler. However, the invention is particularly useful on paper that is produced from mechanical pulps.

BACKGROUND OF THE INVENTION

One of the most important characteristics of paper is the degree of whiteness of the paper. Generally, the whiter the paper, the higher the selling price. Efforts on the part of papermakers to obtain whiter papers have been directed to treatment of the pulp by subjecting it to bleaching agents such as alkaline hypochlorite. However, in bleaching the pulp, large quantities of bleaching agents are required. This contributes to increased production cost, as well as inefficient use and consumption of bleaching agents.

Papermakers who produce paper from mechanical pulps lose brightness due to alkaline darkening of the pulp when fillers such as calcium carbonate are used in the papermaking process. This darkening effect restricts the use of certain fillers, such as calcium carbonate, as well as reduces the price that can be charged for papers whose optical properties are less than desired. Because of the increased cost of using current bleaching techniques, a more economical bleaching technique is required. Additionally, because of the darkening that occurs in paper that contain mechanical pulps and fillers such as calcium carbonate, a technique to regain the brightness losses in this type of paper is required.

What has been found to be novel and unanticipated by the prior art is a process for bleaching papers containing mechanical pulps and fillers such as calcium carbonate, clay, and talc.

It is therefore an object of the present invention to provide a process for brightening filled paper. Another object of the present invention is to provide an economical process for the production of quality paper produced from mechanical pulps and calcium carbonate. Yet another object of the present invention is to provide a finished paper product that is particularly useful in applications where a high degree of whiteness is required. A further object of the invention is to allow the papermaker to increase the brightness of paper without the use of an expensive bleaching plant. A final object of the invention is to allow the papermaker to use calcium carbonate fillers and mechanical pulps for producing paper without suffering the effects of alkaline darkening.

These and other objects of the present invention will become apparent as further provided in the detailed specification which follows.

PRIOR RELATED ART

U.S. Pat. No. 2,150,926 discloses a process for bleaching sheet materials formed of fibrous pulp of vegetable origin by using hydrogen peroxide or substances generating hydrogen peroxide in solution.

U.S. Pat. No. 2,510,595 discloses bleaching of groundwood paper with an alkaline solution containing a per-compound, such as hydrogen peroxide, and a phosphate.

U.S. Pat. No. 2,613,579 discloses simultaneous bleaching and sizing of paper sheets with an alkaline aqueous solution of hydrogen peroxide and a wax dispersion.

According to Tang, "Stabilization of Paper Through Sodium Borohydride Treatment", American Chemical Society, Pages 212, 427–441 (1986), reducing agents, such as sodium borohydride have been used to brighten paper.

None of the above referenced subject matter in whole or in part suggests that filled paper produced with mechanical pulps can be brightened through the use of various bleaching agents.

SUMMARY OF THE INVENTION

What has been found to be novel and unanticipated by prior art is a method for improving the optical properties of filled paper by bleaching the paper.

The process of the present invention is useful on grades of paper that contain filler. The invention is especially useful on grades of paper that are produced from mechanical pulps and calcium carbonate filler.

DETAILED DESCRIPTION OF THE INVENTION

The process of the present invention is useful on grades of paper that contain filler. The present invention is especially useful on grades of paper that are produced from mechanical pulps and contain calcium carbonate.

Calcium carbonate fillers that are useful in the present invention include, but are not limited to, any calcium carbonate containing mineral, for example, limestone, chalk, dolomite, and synthetically produced precipitated calcium carbonate. Other mineral fillers useful in the present invention include talcs, clays, and synthetic silicon based fillers. The filled paper is produced using standard papermaking techniques well known in the art. The filled paper may contain from about 1 percent to about 40 percent by weight filler. The preferred weight of the filler in the paper is dependent upon the particular grade of paper being produced.

Bleaching agents useful in the method of the present invention may be any type of bleaching agent. Bleaching agents especially useful in the method of the present invention are selected from the group consisting of hydrogen peroxide, sodium borohydride, and sodium hydrosulfite. The bleaching agents may be applied as an aqueous solution containing from about 0.1 percent by weight to about 50 percent by weight bleaching agent. Preferably, from about 0.1 percent by weight to about 5 percent by weight based on the weight of the paper is used. More preferably, the level of treating agent is from about 0.1 percent by weight to about 2 percent by weight. The bleaching agent may be applied to the paper after it is produced, such as for example, at the size press or rewinders.

It is believed that when paper containing calcium carbonate is bleached with hydrogen peroxide, the alkalinity of the calcium carbonate activates the hydrogen peroxide, resulting in a greater improvement in brightness. What is being suggested here is a theory of why the method of the present invention allows for the bleaching of calcium carbonate containing paper. It should be accepted only as a theory and should not under any conditions whatsoever by employed to limit the scope of the present invention, which is further illustrated by the Examples which follow, and more specifically defined by the Claims.

EXAMPLES

Example 1

Comparative Turbulent-Pulse Former (manufactured by Paper Research Materials, Inc., Camas, Wash.) handsheets were prepared using a pulp prepared from 100 percent deinked newsprint supplied by Garden State Paper in Garfield, N.J. The pulp was diluted with deionized water to a consistency of about 0.5 percent. Shear speed on the Turbulent Pulse Former was 1000 RPM. Retention agent (high molecular weight cationic or anionic polyacrylamide) was added at about 0.05 percent. Three sets of 40-pound (basis weight) handsheets were prepared containing no filler, 5.5 percent ANSILEX (calcined clay) filler, and 5.6 percent precipitated calcium carbonate filler. The sheets were pressed using a nip pressure of 25 psi and dried on a rotating chrome-plated drum at a temperature of 125° C. The sheets were conditioned at 50 percent relative humidity and 23° C. for a minimum of 24 hours prior to testing. The brightness of the resulting papers was tested using TAPPI test method T452-OM92. The handsheets were subjected to a bleaching treatment of either sodium borohydride or sodium hydrosulfite, in aqueous solution for 1 minute. The bleached handsheets were then pressed and dried again for re-testing. The results are shown in Table 1.

TABLE 1

| Handsheet | Bleaching Treatment | | |
|---|---|---|---|
| | None | 1 lb./ton $NaBH_4$ | 20 lbs./ton $Na_2S_2O_4$ |
| No Filler (Blank) | 55.0 | 55.3 | 55.3 |
| 5.5% ANSILEX Filled (Calcined Clay) | 59.1 | 60.1 | 59.8 |
| 5.6% Precipitated Calcium Carbonate Filled | 56.5 | 57.9 | 59.3 |

Table 1 shows improved brightness is obtained by bleaching clay or calcium carbonate containing papers.

Example 2

Comparative Turbulent-Pulse Former handsheets were prepared from a furnish of Miramichi Dry Groundwood pulp and deionized water. The pulp was mechanically milled on a Disintegrator for 25 minutes and then blended for 2 minutes, after adjusting the pulp consistency to 0.55 percent using deionized water. Retention agent (high molecular weight cationic or anionic polyacrylamide) was added at about 0.05 percent. The sheets were filled with either precipitated calcium carbonate or chalk at target filler levels of 5 and 10 percent. The handsheets were pressed, dried, and conditioned as described in Example 1 prior to testing. The sheets were then subjected to a 1 minute bleaching treatment using 2.5 ml of 0.11 percent hydrogen peroxide solution (10 lb./ton bleach) or 2.5 ml. of 0.22 percent hydrogen peroxide solution (20 lbs./ton bleach). The sheets were then pressed, dried, and conditioned as in Example 1 prior to re-testing. The results are shown in Table 2.

TABLE 2

HYDROGEN PEROXIDE BLEACHING

| Sheet Type | % Filler | PH | Basis Wt. (lbs/3000 $Ft^2$) | Brightness No Bleach | Brightness 10 lbs/ton Bleach | Brightness 20 lbs/ton Bleach | Increase in Brightness (20 lbs/ton) |
|---|---|---|---|---|---|---|---|
| Precipitated Calcium Carbonate | 10.6 | 9.5 | 41.0 | 54.6 | 56.9 | 57.9 | +3.3 |
| Faxe Chalk | 4.7 | 6.3 | 42.3 | 55.0 | 55.1 | 55.9 | +0.9 |

Example 3

In the same manner as described in Example 2, Turbulent-Pulse Former handsheets were prepared using a furnish prepared from Miramichi Dry Groundwood pulp and deionized water at a consistency of 0.55 percent. Retention agent was added at 0.05 percent. The sheets contained precipitated calcium carbonate or calcined clay or chalk or talc as fillers, at filler target levels of 5 and 10 percent. The sheets were pressed, dried, and conditioned as in Example 2 prior to testing. The sheets were then subjected to a 31 minute treatment of 2.5 ml of either 0.11 percent (10 lbs./ton bleach) or 2.5 ml of 0.165 percent (15 lbs/ton bleach) aqueous sodium hydrosulfite. The bleached sheets were then pressed, dried, and conditioned as in Example 2 prior to re-testing. The results are shown in Table 3.

TABLE 3

SODIUM HYDROSULFITE BLEACHING

| Sheet Type | % Filler | PH | Basis Wt. | Brightness No Bleach | Brightness 10 lbs/ton Bleach | Brightness 15 lbs/ton Bleach | Increase in Brightness (10 lbs/ton) |
|---|---|---|---|---|---|---|---|
| Base Stock (No filler) | 0 | 5.4 | 41.0 | 55.0 | 57.7 | 57.2 | +2.7 |
| Precipitated Calcium Carbonate | 10.0 | 8.8 | 40.8 | 55.1 | 60 | 60.1 | +4.9 |
| ANSILEX Calcined Clay | 5.4 | 5.4 | 41.0 | 58.4 | 61.5 | 61.6 | +3.1 |
| Faxe Chalk | 5.0 | 6.3 | 41.4 | 55.8 | 60.1 | 60.1 | +4.3 |
| Kanzaki Talc | 4.8 | 5.8 | 41.0 | 55.4 | 58.8 | 58.9 | +3.4 |

As can be seen in the preceding Examples, bleaching filled paper results in improved paper brightness. This novel method is simple, efficient, and readily adaptable to most paper producing processes.

What is claimed is:

1. A method of improving the brightness of filled paper, comprising:

forming a slurry consisting essentially of mechanical pulp and calcium carbonate filler; forming a filled paper containing from about 1% by weight to about 40% by weight of the filler wherein the filler is selected from the group consisting of limestone, chalk, dolomite and synthetically produced calcium carbonate and the filled paper having a first brightness; drying the filled paper; and treating the dried filled paper with an aqueous solution consisting essentially of from about 0.1% by weight to about 50% by weight of a bleaching agent, wherein the bleaching agent is selected from the group consisting of hydrogen peroxide, sodium borohydride and sodium hydrosulfite to increase the brightness of the filled paper from the first brightness to a second, higher brightness.

2. The method of claim 1 wherein the calcium carbonate filler is synthetically produced calcium carbonate.

* * * * *